US005594536A

United States Patent [19]

Kawabata et al.

[11] Patent Number: 5,594,536

[45] Date of Patent: Jan. 14, 1997

[54] RELIABLE TRANSFER FILM ATTACHMENT STRUCTURE

[75] Inventors: Takashi Kawabata; Nobuo Hyakutake; Fumio Furusawa; Masaaki Tokunaga, all of Ebina, Japan

[73] Assignee: Fuji Xerox Co., Ltd., Tokyo, Japan

[21] Appl. No.: 572,731

[22] Filed: Dec. 14, 1995

[30] Foreign Application Priority Data

Dec. 16, 1994 [JP] Japan ..... 6-313748

[51] Int. Cl.[6] ..... G03G 15/14

[52] U.S. Cl. ..... 399/297; 399/298

[58] Field of Search ..... 355/271, 274, 355/276, 326 R, 327

[56] References Cited

U.S. PATENT DOCUMENTS

| | | | |
|---|---|---|---|
| 5,057,873 | 10/1991 | Sawai et al. | 355/271 |
| 5,084,736 | 1/1992 | Suzuki et al. | 355/271 |
| 5,086,318 | 2/1992 | Takeda et al | 355/271 |
| 5,132,736 | 7/1992 | Muramatsu et al. | 355/271 |
| 5,185,633 | 2/1993 | Kawai et al. | 355/271 |
| 5,327,200 | 7/1994 | Sakakibara et al. | 355/274 |

FOREIGN PATENT DOCUMENTS

| | | |
|---|---|---|
| 4-274269 | 9/1992 | Japan . |
| 6-27836 | 2/1994 | Japan . |

*Primary Examiner*—R. L. Moses
*Attorney, Agent, or Firm*—Oliff & Berridge

[57] ABSTRACT

A rear end plate having openings is bonded to a rear end portion of a transfer film through urethane sponge. To attach the rear end portion of the transfer film to a coupling member of a frame of a transfer material carrying body, restricting portions of respective restricting members are fixed to the coupling member through the respective openings of the rear end plate. The restricting portions of the restricting members abut the top face of the rear end plate so as to restrict a radial movement of the rear end plate and allow its circumferential movement.

9 Claims, 9 Drawing Sheets

RELIABLE TRANSFER FILM ATTACHMENT STRUCTURE

BACKGROUND OF THE INVENTION

1. Field of the Invention

This invention relates to an image forming apparatus such as an electrophotographic copier or printer for forming an image by sequentially forming toner images of different colors on a photoreceptor drum and sequentially transferring, in superimposition, the toner images from the photoreceptor drum onto a transfer material carried by a transfer drum and, in particular, to a technique for attaching a transfer film that is a part of the transfer drum.

2. Description of the Related Art

For example, such a conventional image forming apparatus using a transfer drum forms an image by sequentially forming toner images of different colors such as cyan, magenta, yellow, and black on a photoreceptor drum and sequentially transferring, in superposition, the toner images from the photoreceptor drum to a transfer material such as a transfer sheet carried by a transfer dry. After the transfer of a given number of multiple toner images onto the transfer material that is adsorbed on the transfer dry, the transfer material is stripped off the surface of the transfer drum and the toner images are fused on the transfer material by a fuser.

For example, as shown in FIG. 14, a transfer drum 100 comprises a drum-like free 103 made of metal, for instance, and having a pair of ring members 101 at both ends in the axial direction and a tie-bar plate 102 for coupling the ring members 101 to each other. A circumferential front end portion of a transfer film 104 made of a dielectric film of polyethylene terephthalate, polyvinylidene fluoride, or the like is fixed to the tie-bar plate 102; both side end portions of the transfer film 104 are wound around outer peripheral surfaces of the respective ring members 101 so as to conform to the letter; and a circumferential rear end portion of the transfer film 104 is fixed to the tie-bar plate 102. Thus, the transfer film 104 assumes a hollow cylinder. The front end portion of the transfer film 104 is fixed to the tie-bar plate 102 with screws 105.

The rear end portion of the transfer film 104 is fixed to the tie-bar plate 102 as follows. As shown in FIG. 15B, a rear end plate 107 is fixed to the bottom face of the rear end portion of the transfer film 104 by, for instance, bonding via a urethane sponge 106. As shown in FIG. 15A, the transfer film 104 and the urethane sponge 106 are formed with substantially U-shaped relief portions 108, and insertion holes 109 for screwing are formed in the rear end plate 107 at positions corresponding to the relief portions 108. The rear end portion of the transfer film 104 is fixed to the tie-bar plate 102 by inserting screws 105 into the insertion holes 109 of the rear end plate 107 and threadedly engaging the screws 105 to female screws formed in the tie-bar plate 102.

However, the above conventional image forming apparatus has the following problem. As shown in FIG. 14, when it is attempted to attach the transfer film 104 to the frame 103 of the transfer drum 100, if the length, etc., of the transfer film 104 varies due to the working accuracy of the transfer film 104 itself, variations in the attachment positions of the rear end plate 107 to the transfer film 104, or changes in environmental conditions such as the temperature and humidity, there may occur a case that the positions of the insertion holes 109 of the rear end plate 107 do not match those of the female screws of the tie-bar plate 102 and the rear end plate 107 cannot be screwed to the tie-bar plate 102.

In this state, if an attempt is made to forcibly secure the rear end plate 107 of the transfer film 104 to the tie-bar plate 102 by screws, the rear end portion of the transfer film 104 is much deformed and a transfer material held on the transfer film 104 is deformed together (see FIGS. 16 and 17), thus causing image defects in toner images transferred onto the transfer material.

A technique that can solve the problem is already proposed in Japanese Patent Laid-Open No. Hei. 4-274269. An image forming apparatus according to this publication forms developed images on an image carrying body and transfers the developed images to a transfer material carried by a transfer material holding member of a transfer device, to form an image. The transfer device comprises a transfer drum frame having a pair of annular rotary members and a coupling member for coupling the annular rotary members. The coupling member is provided with retention members for retaining the transfer material holding member, and an elastic member having U-shaped grooves to engage the necks of the respective retention members is formed integrally with a front end portion of the transfer material holding member. The transfer material holding member is made longer than the outer perimeter of the transfer drum frame, and a rear end portion of the transfer material holding member overlapping with the tip of the transfer material holding member is fixed to the front end portion of the transfer material holding member. For example, the rear end portion of the transfer material holding member is bonded to the front end portion of the transfer material holding member.

In this case, however, since the rear end portion of the transfer material holding member is fixed to the front end portion of the transfer material holding member by, for instance, bonding, the tolerable range of deformation of the transfer film with respect to environmental variations is small. Therefore, under a low-temperature condition, the transfer film shrinks to form a recess, causing a transfer failure. Under a high-temperature condition, it expands and becomes loose, creating a color shift, etc., resulting in an image defect.

SUMMARY OF THE INVENTION

It is therefore an object of the invention to provide an image forming apparatus in which a transfer film can be attached reliably and accurately to a frame of a transfer drum even if there occurs some variations in, for instance, the working accuracy of the transfer film.

It is another object of the invention to provide an image forming apparatus which can prevent an image defect such as a color shift or a transfer failure from occurring even if an environmental change occurs.

According to a first aspect of the invention, there is provided an image forming apparatus which forms an image by sequentially forming a plurality of toner images of different colors on an image carrying body, and sequentially transferring, in superimposition, the toner images from the image carrying body onto a transfer material carried by a transfer material carrying body, said image forming apparatus having the transfer material carrying body comprising:

a drum-like frame having a pair of annular members located at both axial ends of the transfer material carrying body and a coupling member for coupling the annular members to each other;

a transfer film attached to the frame such that a circumferential front end portion of the transfer film is fixed to the coupling member, and both side end portions of the transfer film are wound around outer peripheral surfaces of the respective annular members so as to conform to the latter so that the transfer film assumes a hollow cylinder;

a plate-like attachment member fixed only to a rear end portion of the transfer film and having openings; and restricting members fixed to the coupling member through the respective openings of the plate-like attachment member so as to abut a top surface of the plate-like attachment member, to thereby restrict a movement of the plate-like member in a radial direction of the transfer material carrying body while allowing a movement of the plate-like member in a circumferential direction of the transfer material carrying body.

According to a second aspect of the invention, the above-mentioned restricting members are stepped screws each having a shank portion having a smaller diameter than the opening of the plate-like attachment member, and a head portion having a larger diameter than the opening of the plate-like attachment member, a bottom surface of the head portion being higher than a top surface of the plate-like attachment member when the transfer film is attached to the coupling member with the stepped screws.

According to a third aspect of the invention, the above-mentioned openings of the plate-like attachment member include regular openings and spare openings formed at positions different than the regular openings, and the coupling member is formed with regular female screws at positions corresponding to the respective regular openings and spare female screws at positions corresponding to the respective spare openings.

According to a fourth aspect of the invention, there is provided an image forming apparatus which forms an image by sequentially forming a plurality of toner images of different colors on an image carrying body, and sequentially transferring, in superimposition, the toner images from the image carrying body onto a transfer material carried by a transfer material carrying body, said image forming apparatus having the transfer material carrying body comprising:

a drum-like frame having a pair of annular members located at both axial ends of the transfer material carrying body and a coupling member for coupling the annular members to each other;

a transfer film attached to the frame such that a circumferential front end portion of the transfer film is fixed to the coupling member, and both side end portions of the transfer film are wound around outer peripheral surfaces of the respective annular members so as to conform to the latter so that the transfer film assumes a hollow cylinder;

a plate-like attachment member fixed only to a rear end portion of the transfer film; and a restricting member fixed to the coupling member between the front and rear end portions of the transfer film so as to abut a top surface of the plate-like attachment member, to thereby restrict a movement of the plate-like member in a radial direction of the transfer material carrying body while allowing a movement of the plate-like member in a circumferential direction of the transfer material carrying body.

DESCRIPTION OF THE PREFERRED EMBODIMENTS

Referring now to the accompanying drawings, preferred embodiments of the invention will be described.

EMBODIMENT 1

Figure 4:
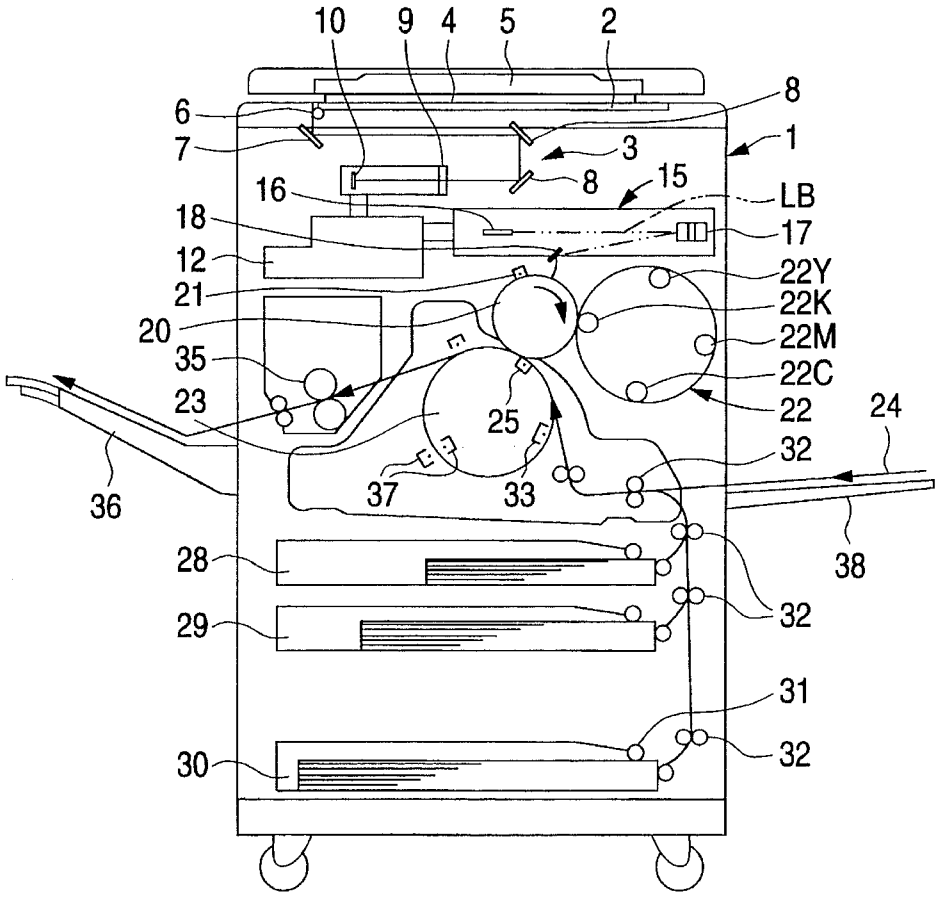
FIG. 4 shows the configuration of an image forming apparatus according to the invention.

FIG. 4 shows a multiple transfer type digital color image forming apparatus as an image forming apparatus according to the invention.

In FIG. 4, numeral 1 denotes a main unit of the digital color image forming apparatus. An image input terminal 3 for reading a document 2 occupies an upper end portion of the main unit 1 of the digital color image forming apparatus. The image input terminal 3 illuminates, with a light source 6, the document 2 placed on a platen glass 4 so as to be pressed by a platen cover 5, and scans and exposes the document 2 to produce a reflected light image of the document 2, which is supplied to a CCD sensor 10 via first and second scanning mirrors 7 and 8, and an image formation lens 9. The CCD sensor 10 reads reflected light images of the document 2 at a predetermined dot density, for example, 16 dots/mm.

The reflected light images of the document 2 read by the image input terminal 3 is sent to an image processing system 12 as 3-color document reflectance data of, for instance, red (R), green (G), and blue (B) (8 bits for each color). The image processor 12 applies predetermined image processing such as shading correction, displacement correction, lightness/color space conversion, gamma correction, frame erasure, and color/movement editing to the reflectance data of the document 2.

The image data to which the predetermined image proceeding has been applied by the image processor 12 as described above is converted into 3-color colorant gradation data of black (K), yellow (Y), magenta (M), and cyan (C) (8 bits for each color), and sent to a ROS (raster output scanner) 15, which then performs image exposure with a laser beam in accordance with the colorant gradation data.

As shown in FIG. 4, the ROS 15 modulates a semiconductor laser 16 in accordance with the colorant gradation data 14, to cause the semiconductor laser 16 to emit a laser beam LB in accordance with the gradation data 14. The laser beam LB output from the semiconductor laser 16 is deflected by a rotary polygon mirror 17, and scans a photoreceptor drum 20 via a reflection mirror 18.

The photoreceptor drum 20 is rotated by a drive means (not shown) at a predetermined speed in a direction indicated by an arrow in FIG. 4. After the surface of the photoreceptor drum 20 is charged at a predetermined potential by a charging corotron 21, it is scanned with the laser light LB in accordance with the colorant gradation data, whereby an electrostatic latent image is formed. The electrostatic latent images formed on the photoreceptor drum 20 are developed in sequence by a rotary developing machine 22 comprising 4-color developing devices 22K, 22Y, 22M and 22C of black (K), yellow (Y), magenta (M) and cyan (C), to form toner images of predetermined colors.

The toner images formed on the photoreceptor drum 20 are transferred in sequence onto a transfer sheet 24 as a transfer material held on a transfer drum 23 that adjoins the photoreceptor drum 20, by charging with a transfer corotron 25. As shown in FIG. 4, the transfer material 24 is fed by a paper feed roller 31 from one of paper feed cassettes 28, 29 and 30 disposed in a lower portion of the image forming apparatus main unit 1, or fed from a manual feed tray 38 attached to a side outside surface of the image forming apparatus main unit 1. The transfer material 24 thus fed is transported to the surface of the transfer drum 23 by transport rollers 32, and held on the surface of the transfer drum 23 being electrostatically adsorbed on the surface of the transfer drum 23 by charging with a charging corotron 33. Transparent OHP sheets for an overhead projector or the like can also be fed from the manual feed tray 38 in addition to transfer sheets of irregular forms, and therefore an image can also be formed on OHP sheets or the like. A transfer material 24 with an image formed on one side may be turned and fed from the manual feed tray 38, to make a double-sided copy.

The transfer material 24 to which toner images of a predetermined number of colors have been transferred from the photoreceptor drum 20 is stripped off the surface of the transfer drum 23 by charging with a stripping corotron 34, and transported to a fuser 35, which fuses the toner images on the transfer material 24 by applying heat and pressure thereto. The transfer material 24 is thereafter discharged onto a paper output tray 36. The color image formation process is thus completed.

In FIG. 4, numeral 37 denotes an electricity removal corotron for removing electricity from the transfer drum 23.

Figure 5:
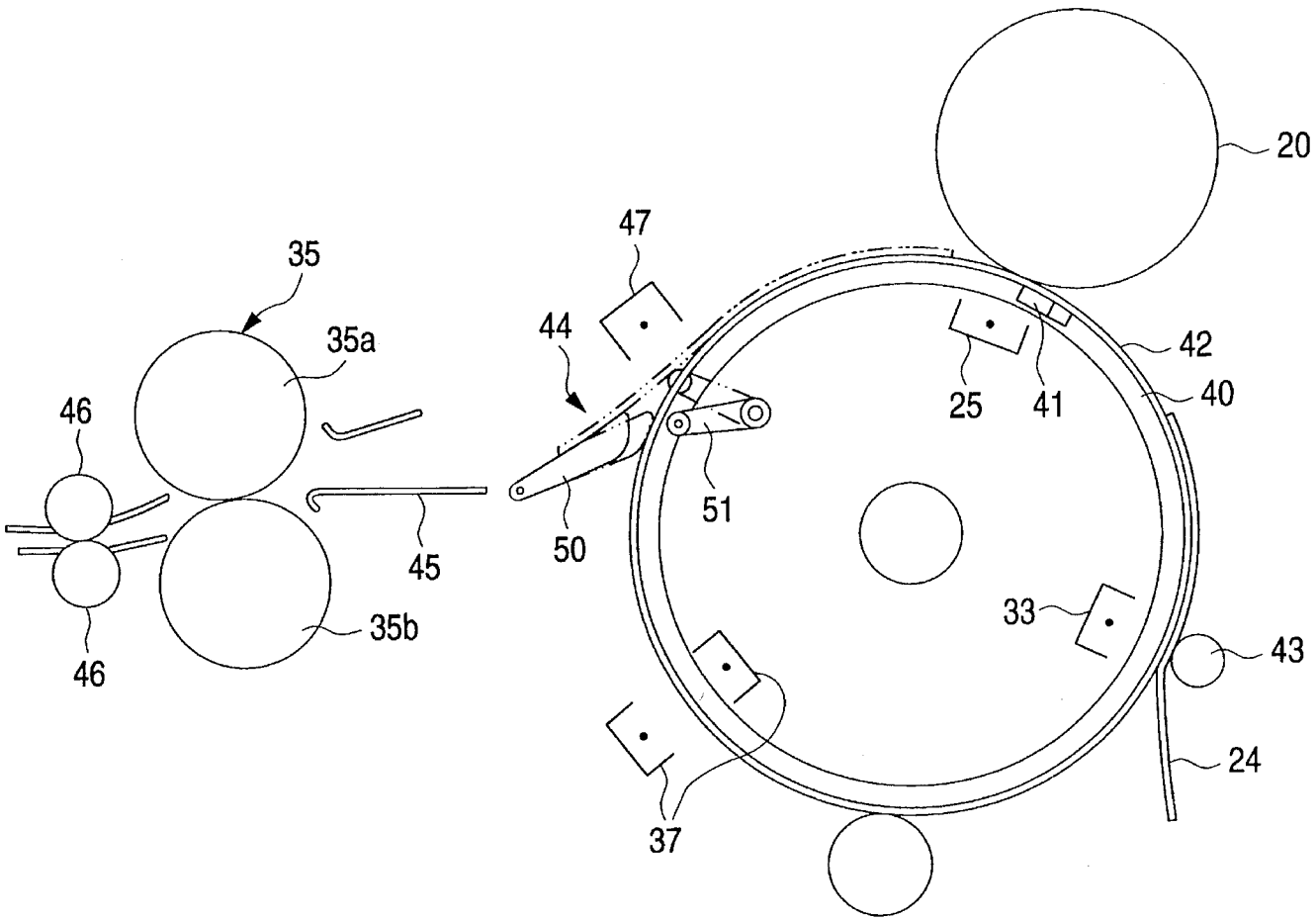
FIG. 5 shows the configuration of an image formation section according to the invention.

FIG. 5 shows the configuration of the image forming section of the multiple transfer type digital color image forming apparatus described above.

Figure 6:
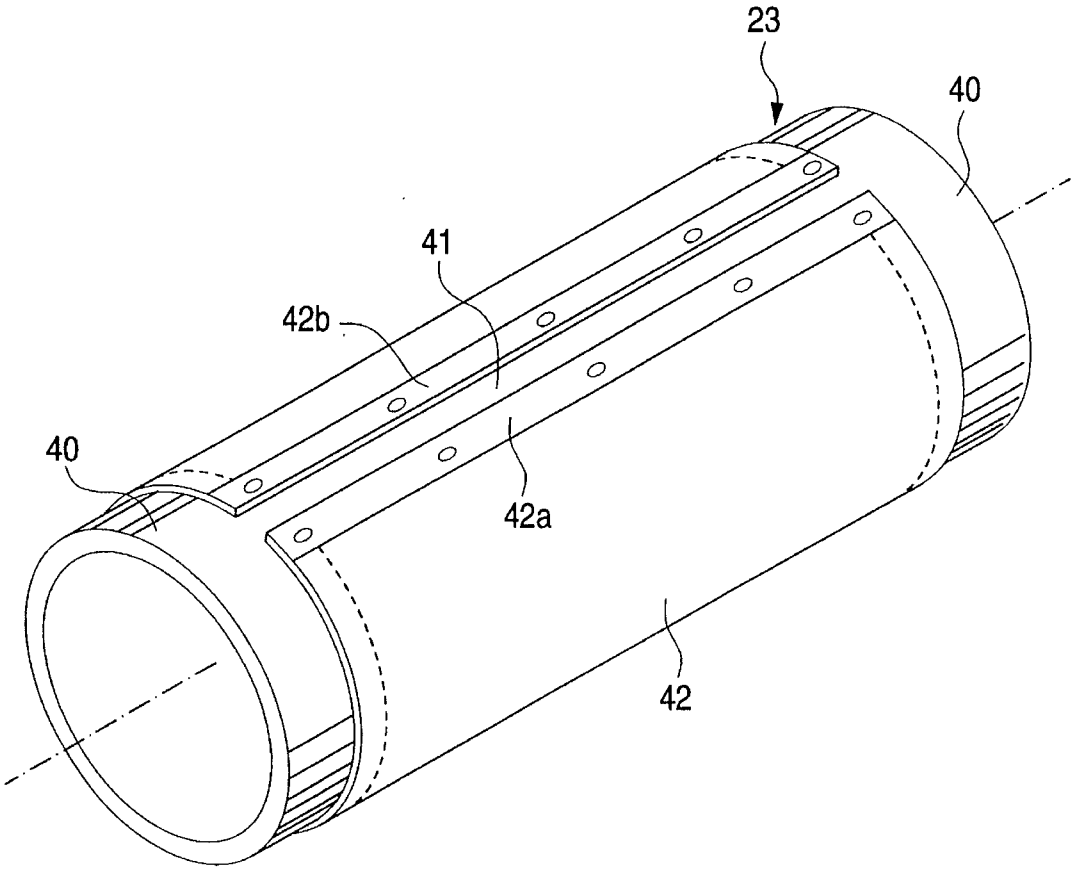
FIG. 6 is a perspective view showing a transfer drum.

In FIG. 5, the transfer drum 23 as a transfer material carrying body is disposed so as to come in contact with the surface of the photoreceptor drum 20. The transfer drum 23 is rotated by a drive mechanism (not shown) at the same circumferential speed as the photoreceptor drum 20. As shown in FIG. 6, the transfer drum 23 comprises a drum-like frame having a pair of ring members 40 as annular members at both end portions in the axial direction and a tie-bar plate 41 as a coupling member for coupling the ring members 40 to each other. A circumferential front end portion **42*a* of a transfer film 42 made of a dielectric film of polyethylene terephthalate, polyvinylidene fluoride, or the like is fixed to the tie-bar plate 41; both side end portions of the transfer film 42 are wound around the frame so as to conform to outer peripheral surfaces of the respective ring members 40; and a circumferential rear end portion 42*b* of the transfer film 42 is fixed to the tie-bar plate 41 in a manner as described below. Thus, the transfer film 42** assumes a hollow cylinder.

A transfer material 24 is supplied to the transfer drum 13 from one of the paper feed cassettes 28 to 30 as described above, and pressed against the surface of the transfer drum 23 by an adsorption roller 43 while being adsorbed electrostatically on the transfer film 42 of the transfer drum 23 being charged by the adsorption corotron 33 from the back side of the transfer drum 23. Black (K), yellow (Y), magenta (M) and cyan (C) toner images formed in sequence on the photoreceptor drum 20 are transferred to the transfer material 24 being adsorbed on the transfer drum 23, by charging with the transfer corotron 25.

The transfer material 24 to which the toner images of a predetermined number of colors have been transferred from the photoreceptor drum 20 is stripped off the surface of the transfer drum 23 by a stripping device 44, and transported via a transport guide 45 to the fuser 35. The toner images are fused on the transfer material 24 by application of heat and pressure by a fixing roller **35*a* and a pressure roller 35*b* of the fuser 35, and then the transfer material 24 is discharged through a fuser exit rollers 46 to the paper outlet tray 36 outside the apparatus main unit 1**.

Figure 1:
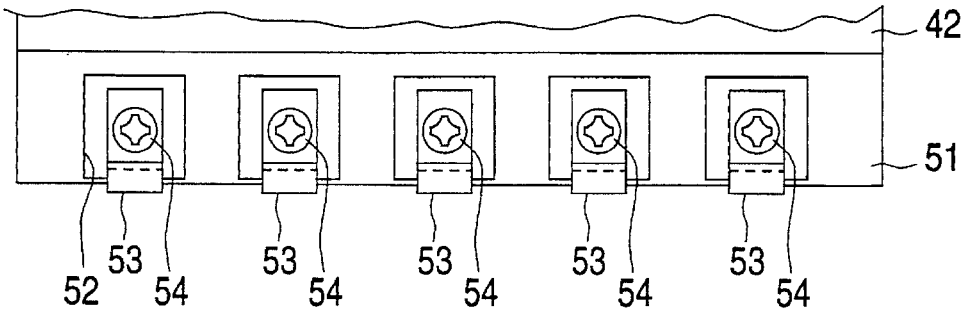
FIG. 1 is a plan view showing a transfer film attaching portion of an image forming apparatus according to a first embodiment of the invention.
Figure 2:
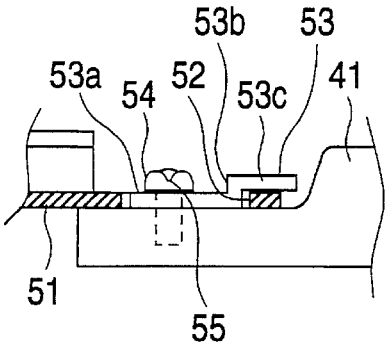
FIG. 2 is a sectional view showing how a transfer film is attached to a coupling member in the first embodiment.
Figure 3:
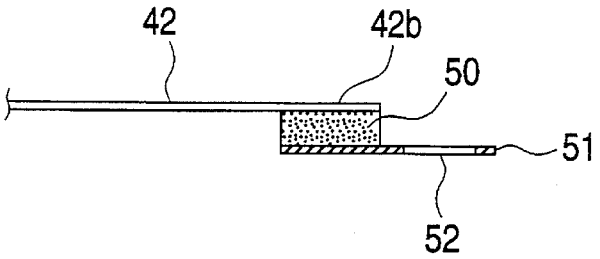
FIG. 3 is a sectional view showing the transfer film attachment part of FIG. 1.

As shown in FIG. 3, a rear end plate 51 as a plate-like attachment member made of a metal plate is fixedly secured to the bottom face of the rear end portion **42*b* of the transfer film 42 via a urethane sponge 50 as an elastic member by, for instance, bonding. The urethane sponge 50 (elastic member) is not always necessary, and the rear end plate 51 may be made of a material other than metal, for instance, a molded article of synthetic resin. As shown in FIGS. 1 to 3, a plurality rectangular fixation holes 52 as relief portions for fixing the rear end portion 42*b* of the transfer film 42 to the tie-bar plate 41 of the frame of the transfer drum 23 are formed in the rear end plate 51 at predetermined intervals in the axial direction of the transfer drum 23. Further, restricting members 53 are fixed to the tie-bar plate 41 through the rectangular fixation holes 52 of the rear end plate 51. Each restricting member 53 has a step 53*b* that abuts the top face of the rear end plate 51, to thereby restrict a radial movement of the rear end plate 51** while allowing its circumferential movement.

As shown in FIGS. 1 and 2, each restricting member 53, which is formed of a plate material such as metal or plastic, consists of a rectangular fixation part **53*a* that is smaller than the fixation hole 52 of the rear end plate 51 and has an insertion hole 55 for insertion of a screw 54 for fixation to the tie-bar plate 41, and a restricting part 53*c* extending horizontally via a step 53*b* from one end of the fixation part 53*a*. The height of the restricting member 53 to the back face of the restricting part 53*b* is set slightly larger than the thickness of the rear end plate 51 so as to restrict a movement of the rear end plate 51 in the radial direction of the transfer drum 23 while allowing its circumferential movement. Thus, when the restricting members 53 are fixed to the tie-bar plate 41 by screws 54, their restricting parts 53***c* restrict a movement of the rear end plate 51 in the radial direction of the transfer drum 23 while allowing its circumferential movement.

With the above-described configuration, the image forming apparatus of this embodiment enables a transfer film 42 to be reliably and accurately attached to the frame forming a part of the transfer drum 23 even if there occur some variations in the working accuracy, etc. of the transfer film 42, as described below. In the image forming apparatus according to this embodiment, as shown in FIG. 5, black (K), yellow (Y), magenta (M) and cyan (C) toner images formed on the photoreceptor drum 20 are sequentially transferred, in superimposition, onto the transfer material 24 adsorbed on the transfer drum 23 as the transfer drum 23 is rotated. Then, the transfer material 24 to which the toner images of a predetermined number of colors have been transferred is stripped off the surface of the transfer drum 23 by the stripping device 44, and the fusing process is executed by the fuser 35.

If, for instance, the rear end portion 42*b* of the transfer film 42 that is a part of the transfer drum 23 were deformed due to an error in the attachment position, environmental variations, etc., toner images transferred to the transfer material 24 adsorbed on the transfer film 42 would be deformed, deteriorating image quality.

However, in this embodiment, as shown in FIG. 1, a plurality of rectangular fixation holes 52 are formed in the rear end plate 51 fixedly secured to the rear end portion 42*b* of the transfer film 42, and the fixation parts 53*a* of the restricting members 53 are placed in the fixation holes 52 formed in the rear end plate 51. As shown in FIG. 2, the restricting part 53*c* of each restricting member 53 extends from the step 53*b* past the end of the rear end plate 51, and the fixation part 53*a* is fixed to the tie-bar plate 41 through the insertion hole 55 by engaging the screw 54 with the corresponding female screw formed in the tie-bar plate 41. Thus, the rear end plate 51 is attached to the tie-bar plate 41 so that the restricting members 53 restrict a movement of the rear end plate 51 in the radial direction of the transfer drum 23 while allowing its circumferential movement.

Therefore, even if there occur some variations in the working accuracy, etc., of the transfer film 42, the transfer film 42 can be reliably and accurately attached to the frame of the transfer drum 23. Further, even if an environmental variation occurs, an image defect such as a color shift or a transfer failure can be prevented.

The elastic member (urethane sponge 50) increases the tolerance range of the circumferential movement, and absorbs the height difference of the restricting member 53. Further, the elastic member alleviates an impact exerted on the rear end portion, possibly preventing the rear end portion from being damaged.

In addition, the fixation holes 52 allow the restricting members 53 to be fixed to the coupling member 41 within the area of the rear end plate 51, thereby contributing to space saving.

EMBODIMENT 2

Figure 7:
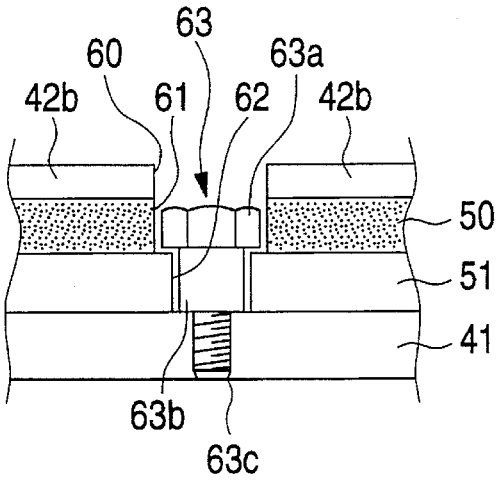
FIG. 7 is a sectional view showing a transfer film attaching portion according to a second embodiment of the invention.
Figure 8:
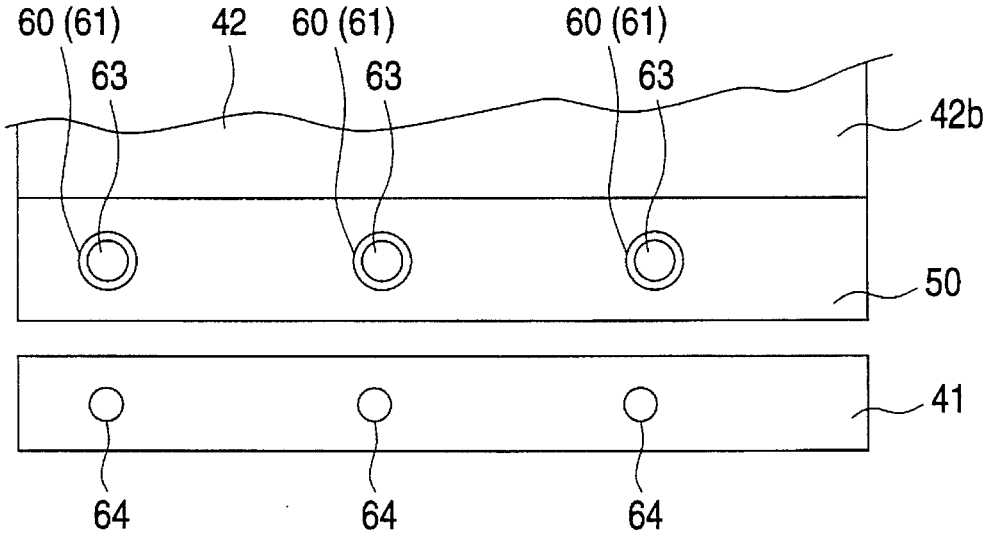
FIG. 8 is a plan view showing the transfer film attaching portion of FIG. 7.

FIGS. 7 and 8 show a second embodiment of the invention. Parts identical with those previously described in the first embodiment will be denoted by the same reference numerals.

Figure 9A:
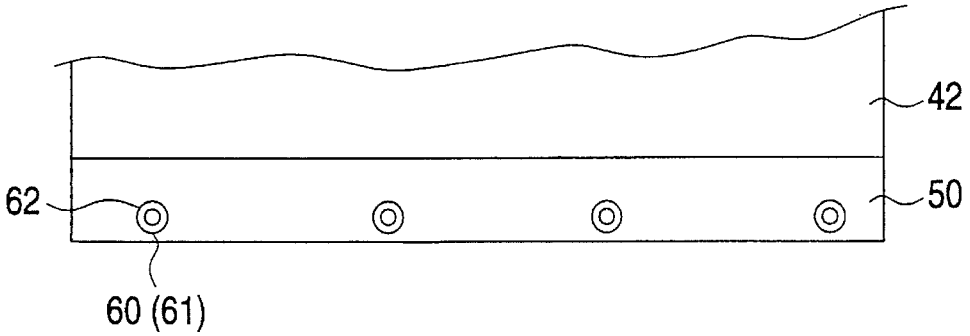
FIGS. 9A and 9B are a plan view and a sectional view showing the transfer film attaching portion of FIG. 7.
Figure 9B:
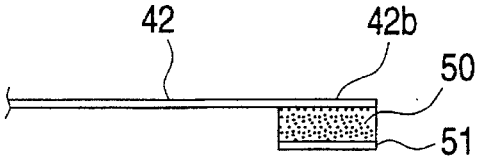

In this embodiment, as shown in FIG. 9B, a rear end plate 51 as a plate-like attachment member made of a metal plate is fixedly secured to the bottom face of a rear end portion 42*b* of a transfer film 42 via a urethane sponge 50 as an elastic member by, for instance, bonding. As shown in FIGS. 7 and 9A, plural sets of circular insertion holes 60, 61 and 62 as relief portions are formed in the transfer film 42, the urethan sponge 50, and the rear end plate 51 predetermined intervals. The insertion holes 60 and 61 formed in the transfer film 42 and the urethan sponge 50 have the same, relatively large diameter to allow insertion of a head 63*a* of a stepped screw 63 described below, and the insertion hole 62 formed in the rear end plate 51 has a smaller diameter than the head 63*a* of the stepped screw 63 to allow insertion of a step portion 63*b* of the stepped screw 63. The length of the step, portion 63*b* of the stepped screw 63 is set slightly larger than the thickness of the rear end plate 51. As a result, when the stepped screws 63 are screwed to the tie-bar plate 41, the heads 63*a* of the stepped screws 63 restrict a movement of the rear end plate 51 in the radial direction of the transfer drum 23 while allowing its circumferential movement. As shown in FIG. 8, the tie-bar plate 41 of the transfer drum 23 is formed with a plurality of female screws 64 for engaging with thread portions 63*c* of the stepped screws 63 at positions corresponding to the insertion holes 62 of the rear end plate 51.

In this embodiment, as shown in FIG. 7, the insertion holes 60, 61 and 62 of the transfer film 42, the urethane sponge 50, and the rear end plate 51 are aligned with the female screws 64 of the tie-bar plate 41 of the transfer drum 23, then the stepped screws 63 are inserted into the insertion holes 60, 61 and 62, and the thread portions 63*c* of the stepped screws 63 are engaged with the female screws 64 of the die-bar plate 41.

Thus, the rear end portion 42*b* of the transfer film 42 is attached to the tie-bar plate 41 by means of the stepped screws 63 so as to restrict a radial movement of the rear end plate 51 while allowing its circumferential movement. Therefore, the attachment of the rear end portion 42*b* of the transfer film 42 is facilitated. Further, even if there occur some variations in the working accuracy, etc. of the transfer film 42, the transfer film 42 can be reliably and accurately attached to the frame of the transfer drum 23. Even if an environmental variation occurs, an image defect such as a color shift or transfer failure can be prevented.

By using the stepped screws 53 as the restricting members, the restricting members can be fixed to the coupling member 41 within the area of the rear end plate 51, contributing to space saving.

The other configuration and function of the second embodiment is the same as those of the first embodiment, and therefore are not describer here.

EMBODIMENT 3

Figure 10:
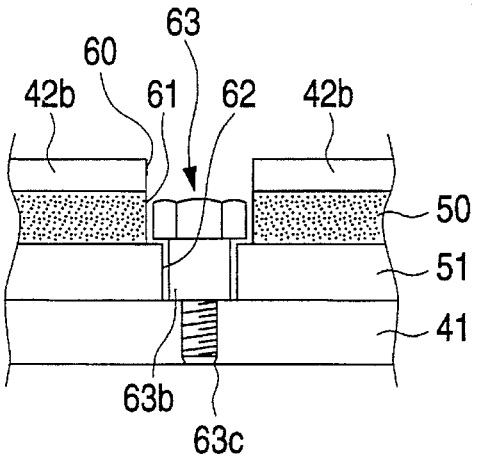
FIG. 10 is a sectional view showing a transfer film attaching portion according to a third embodiment of the invention.
Figure 11:
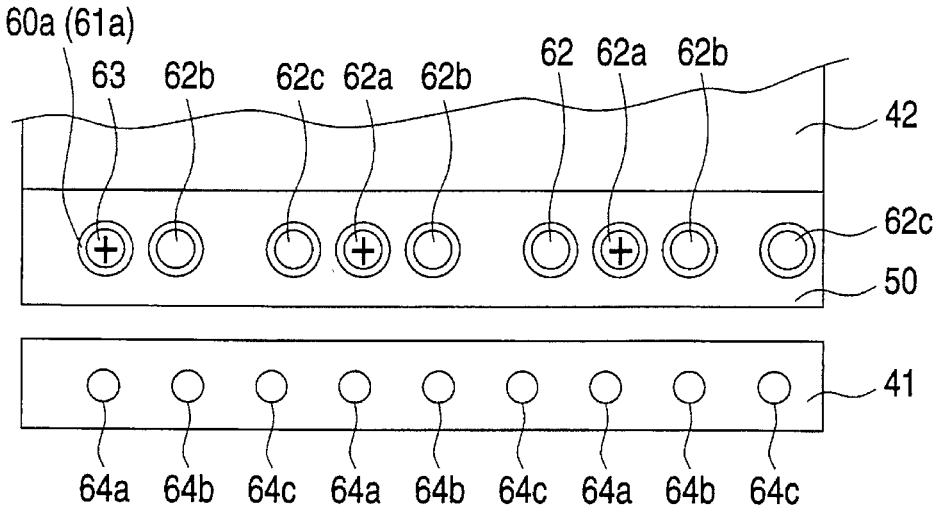
FIG. 11 is a plan view showing the transfer film attaching portion of FIG. 10.

FIGS. 10 and 11 show a third embodiment of the invention. Parts identical with those previously described in the first and second embodiments are denoted by the same reference numerals.

In this embodiment, as shown in FIG. 10, a rear end plate 51 as a plate-like attachment member made of a metal plate is fixedly secured to the bottom face of a rear end portion 42*b* of a transfer film 42 via a urethane sponge 50 as an elastic member by, for instance, bonding. As shown in FIGS. 11, plural sets of circular insertion holes 60, 61 and 62 as relief portions are formed in the transfer film 42, the urethan sponge 50, and the rear end plate 51 at predetermined intervals. The insertion holes 60 and 61 formed in the transfer film 42 and the urethan sponge 50 have the same, relatively large diameter to allow insertion of a head 63*a* of a stepped screw 63 described below, and the insertion hole 62 formed in the rear end plate 51 has a smaller diameter than the head 63*a* of the stepped screw 63 to allow insertion of a step portion 63*b* of the stepped screw 63. The length of the step portion 63*b* of the stepped screw 63 is set slightly larger than the thickness of the rear end plate 51. As a result, when the stepped screws 63 are screwed to the tie-bar plate 41, the heads 63*a* of the stepped screws 63 restrict a movement of the rear end plate 51 in the radial direction of the transfer drum 23 while allowing its circumferential movement. The tie-bar plate 41 of the transfer drum 23 is formed with a plurality of female screws 64 for engaging with thread portions 63*c* of the stepped screws 63 at positions corresponding to the insertion holes 62 of the rear end plate 51.

By the way, in this embodiment, as the insertion holes 60, 61 and 62 formed in the rear end plate 51, etc., spare insertion holes 60*b*, 61*b* and 62*b*, and 60*c*, 61*c* and 62*c* are formed in addition to regular insertion holes 60*a*, 61*a* and 62*a* at positions deviated in the axial direction of the transfer drum 23 from the regular insertion holes 60*a*, 61*a* and 62*a*. And as the female screws 64 in the tie-bar plate 41, spare female screws 64*b* and 64*c* are formed in addition to regular female screws 64*a* at positions deviated in the axial direction of the transfer drum 23 from the regular female screws 64*a*.

Therefore, even if the insertion holes 60*a*, 61*a* and 62*a* of the rear end plate 51 are much deviated from the female screws 64*a* of the tie-bar plate 41 in the axial direction of the transfer drum 23 because of, for instance, variations in the working accuracy of the transfer film 23, either the spare insertion holes 60*b*, 61*b* and 62*b* or the spare insertion holes 60*c*, 61*c* and 62*c* of the rear end plate 51 and either the spare female screws 64*b* or the spare female screws 64*c* of the tie-bar plate 41 may be properly selected. Thus, the transfer film 42 can be attached to the frame of the transfer drum 23 reliably and accurately.

The other configuration and function of the third embodiment is the same as those of the second embodiment, and therefore are not describer here.

EMBODIMENT 4

Figure 12:
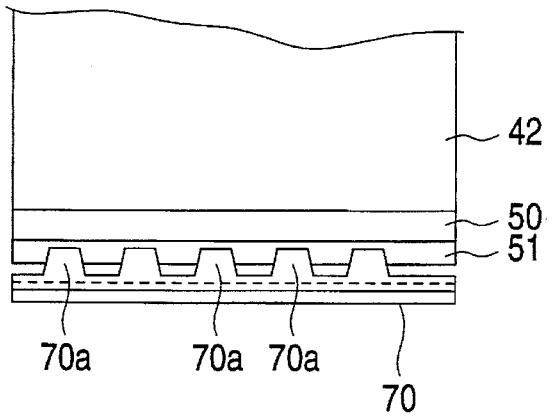
FIG. 12 is a plan view of showing a transfer film attaching portion according to a fourth embodiment of the invention.
Figure 13:
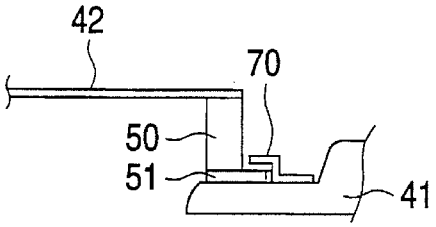
FIG. 13 is a sectional view showing the transfer film attaching portion of FIG. 12.
Figure 14:
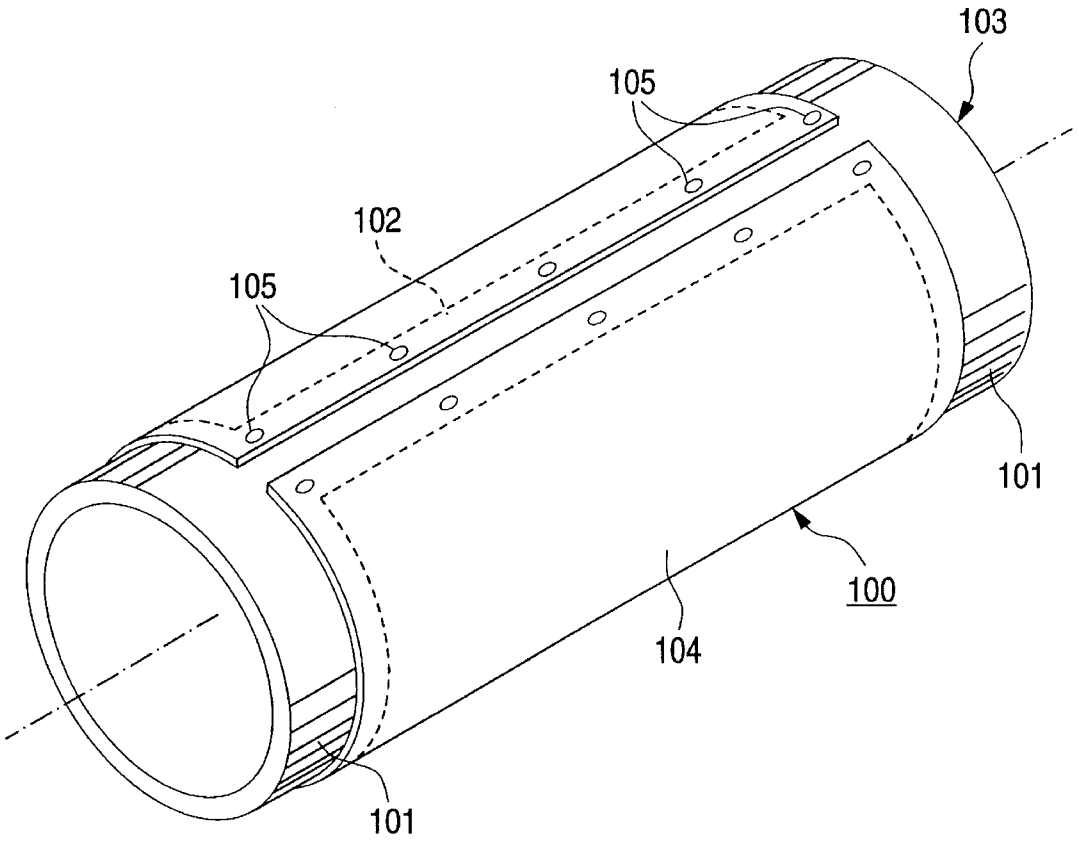
FIG. 14 PRIOR ART
FIG. 14 is a perspective view showing a conventional transfer drum.
Figure 15A:
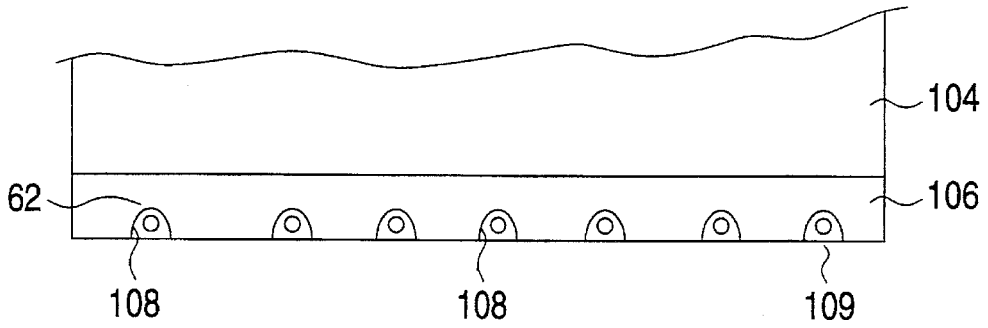
FIG. 15A PRIOR ART
FIGS. 15A and 15B are a plan view and a sectional view showing a transfer film attaching portion of a conventional image forming apparatus.
Figure 15B:
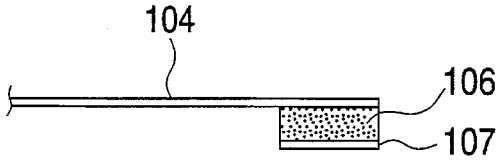
FIG. 15B PRIOR ART
Figure 16:
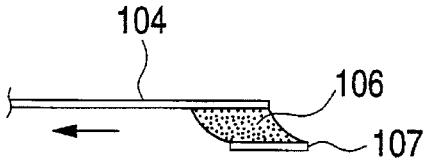
FIG. 16 PRIOR ART
FIGS. 16 and 17 are sectional views showing conventional transfer film attaching portions being deformed.
Figure 17:
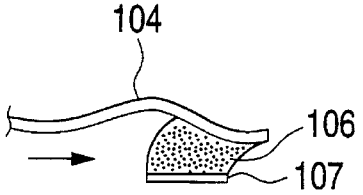
FIG. 17 PRIOR ART

FIGS. 12 and 13 show a fourth embodiment of the invention. Parts identical with those previously described in the above-mentioned embodiments are denoted by the same reference numerals.

In the embodiment, as shown in FIGS. 12 and 13, a rear end plate 51 as a plate-like attachment member made of a metal plate is fixedly secured to the bottom face of a rear end portion 42*b* of a transfer film 42 via a urethane sponge 50 as an elastic member by, for instance, bonding, and a part of the rear end plate 51 projects backward by a predetermined length from the rear end portion 42*b* of the transfer film 42. A leaf spring member 70 as a restricting member for restricting a movement of the rear end plate 51 in the radial direction of the transfer drum 23 while allowing its circumferential movement is fixedly secured by, for instance, screwing or bonding to a tie-bar plate 41 to which the transfer film 42 is to be attached. The leaf spring member 70 is typically formed of a metal plate, but may be formed of a synthetic resin plate or the like. The leaf spring member 70 is formed with a plurality of leaf springs 70*a* extending to the side of the rear end plate 51 as shown in FIG. 12, and such gaps as restrict a movement of the rear end plate 51 in the radial direction of the transfer drum 23 and allow its circumferential movement are set between the leaf springs 70*a* and the surface of the tie-bar plate 41. Where the leaf springs 70*a* are low in elasticity, they may come in contact with the surface of the rear end plate 51 to impart weak force thereto.

with the above configuration, the transfer film 42 can be reliably and accurately attached to the frame of the transfer drum 23 by a simple operation, i.e., by holding the rear end plate 51 by the leaf springs 70*a* of the leaf spring member 70.

Although in the fourth embodiment the leaf spring member 70 is formed with the leaf springs 70*a*, the leaf spring member 70 may have a single leaf spring covering the entire axial width of the rear end plate 51. In the latter case, the transfer film attaching operation is facilitated, and the accuracy of the restricting member 70 can be secured easily.

The other configuration and function of the third embodiment is the same as those of the second embodiment, and therefore are not describer here.

What is claimed is:

1. A transfer material carrying body used in an image forming apparatus which forms an image by sequentially forming a plurality of toner images of different colors on an image carrying body, and sequentially transferring, in superimposition, the toner images from the image carrying body onto a transfer material carried by the transfer material carrying body, said transfer material carrying body comprising:

a drum-like frame having a pair of annular members located at both axial ends of the transfer material carrying body and a coupling member for coupling the annular members to each other;

a transfer film attached to the frame such that a circumferential front end portion of the transfer film is fixed to the coupling member, and both side end portions of the transfer film are wound around outer peripheral surfaces of the respective annular members so as to conform to the latter so that the transfer film assumes a hollow cylinder; and a restricting member fixed to the coupling member so as to abut only a top surface of only a rear end portion of the transfer film.

2. An image forming apparatus which forms an image by sequentially forming a plurality of toner images of different colors on an image carrying body, and sequentially transferring, in superimposition, the toner images from the image carrying body onto a transfer material carried by a transfer material carrying body, said image forming apparatus having the transfer material carrying body comprising:

a drum-like frame having a pair of annular members located at both axial ends of the transfer material carrying body and a coupling member for coupling the annular members to each other;

a transfer film attached to the frame such that a circumferential front end portion of the transfer film is fixed to the coupling member, and both side end portions of the transfer film are wound around outer peripheral surfaces of the respective annular members so as to conform to the latter so that the transfer film assumes a hollow cylinder; and a restricting member fixed to the coupling member so as to abut only a top surface of only a rear end portion of the transfer film.

3. An image forming apparatus which forms an image by sequentially forming a plurality of toner images of different colors on an image carrying body, and sequentially transferring, in superimposition, the toner images from the image carrying body unto a transfer material carried by a transfer material carrying body, said image forming apparatus having the transfer material carrying body comprising:

a drum-like frame having a pair of annular members located at both axial ends of the transfer material carrying body and a coupling member for coupling the annular members to each other;

a transfer film attached to the frame such that a circumferential front end portion of the transfer film is fixed to the coupling member, and both side end portions of the transfer film are wound around outer peripheral surfaces of the respective annular members so as to conform to the latter so that the transfer film assumes a hollow cylinder;

a plate-like attachment member fixed only to a rear end portion of the transfer film and having openings; and restricting members fixed to the coupling member through the respective openings of the plate-like attachment member so as to abut a top surface of the plate-like attachment member, to thereby restrict a movement of the plate-like member in a radial direction of the transfer material carrying body while allowing a movement of the plate-like member in a circumferential direction of the transfer material carrying body.

4. The image forming apparatus as claimed in claim 3, wherein said transfer material carrying body further comprising an elastic member inserted between and fixed to both of the transfer film and the plate-like attachment member.

5. The image forming apparatus as claimed in claim 3, wherein said restricting members are stepped screws each having a shank portion having a smaller diameter than the opening of the plate-like attachment member, and a head portion having a larger diameter than the opening of the plate-like attachment member, a bottom surface of the head portion being higher than a top surface of the plate-like attachment member when the transfer film is attached to the coupling member with the stepped screws.

6. The image forming apparatus as claimed in claim 5, wherein the openings of the plate-like attachment member include regular openings and spare openings formed at positions different than the regular openings, and the coupling member is formed with regular female screws at positions corresponding to the respective regular openings and spare female screws at positions corresponding to the respective spare openings.

7. An image forming apparatus which forms an image by sequentially forming a plurality of toner images of different colors on an image carrying body, and sequentially transferring, in superimposition, the toner images from the image carrying body onto a transfer material carried by a transfer material carrying body, said image forming apparatus having the transfer material carrying body comprising:

a drum-like frame having a pair of annular members located at both axial ends of the transfer material carrying body and a coupling member for coupling the annular members to each other;

a transfer film attached to the frame such that a circumferential front end portion of the transfer film is fixed to the coupling member, and both side end portions of the transfer film are wound around outer peripheral surfaces of the respective annular members so as to conform to the latter so that the transfer film assumes a hollow cylinder;

a plate-like attachment member fixed only to a rear end portion of the transfer film; and a restricting member fixed to the coupling member between the front and rear end portions of the transfer film so as to abut a top surface of the plate-like attachment member, to thereby restrict a movement of the plate-like member in a radial direction of the transfer material carrying body while allowing a movement of the plate-like member in a circumferential direction of the transfer material carrying body.

8. The image forming apparatus as claimed in claim 7, wherein said restricting member has a single restricting member abutting the top surface of the plate-like attachment member over its entire width in an axial direction of the transfer material carrying body.

9. A method for attaching a transfer film to a transfer material carrying body in an image forming apparatus which forms an image by sequentially forming a plurality of toner images of different colors on an image carrying body, and sequentially transferring, in superimposition, the toner images from the image carrying body onto a transfer material carried by a transfer material carrying body, comprising the steps of:

fixing a circumferential front end portion of the transfer film to a coupling member of a drum-like frame having a pair of annular members located at both axial ends of the transfer material carrying body and the coupling member for coupling the annular members to each other, and winding both side end portions of the transfer film around outer peripheral surfaces of the respective annular members so that they conform to the latter, to thereby allow the transfer film to assume a hollow cylinder;

fixing a plate-like attachment member having openings only to a rear end portion of the transfer film; and fixing restricting members no the coupling member through the respective openings of the plate-like attachment member so that they abut a top surface of the plate-like attachment member.

* * * * *